US011330958B2

(12) United States Patent
Feddema

(10) Patent No.: US 11,330,958 B2
(45) Date of Patent: May 17, 2022

(54) DISHWASHER WITH A SPRAYER

(71) Applicant: Whirlpool Corporation, Benton Harbor, MI (US)

(72) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 138 days.

(21) Appl. No.: 16/711,896

(22) Filed: Dec. 12, 2019

(65) Prior Publication Data

US 2021/0177237 A1 Jun. 17, 2021

(51) Int. Cl.
*A47L 15/42* (2006.01)
*A47L 15/22* (2006.01)

(52) U.S. Cl.
CPC ..... *A47L 15/4221* (2013.01); *A47L 15/22* (2013.01); *A47L 15/4282* (2013.01)

(58) Field of Classification Search
CPC ... A47L 15/4221; A47L 15/22; A47L 15/4282
See application file for complete search history.

(56) References Cited

U.S. PATENT DOCUMENTS 6,795,981 B2 9/2004 Sato et al.
8,066,199 B2 11/2011 Spinelli et al.
8,602,042 B2 12/2013 Grull et al.
9,420,938 B2 8/2016 Forst et al.
9,693,672 B2 7/2017 Feddema
2013/0074887 A1* 3/2013 Feddema ..... A47L 15/23 134/172
2013/0206188 A1* 8/2013 Busing ..... A47L 15/22 134/172

(Continued)

FOREIGN PATENT DOCUMENTS

CN 106308716 A * 1/2017
DE 102012103445 A1 10/2013

(Continued)

OTHER PUBLICATIONS

MSE supplies—Thermal expansion data https://www.msesupplies.com/pages/list-of-thermal-expansion-coefficients-cte-for-natural-and-engineered-materials (Year: 2018).*

(Continued)

*Primary Examiner* — Michael E Barr
*Assistant Examiner* — Pallavi Chitta
(74) *Attorney, Agent, or Firm* — McGarry Bair PC

(57) ABSTRACT

A dish treating appliance for treating dishes according to an automatic cycle of operation can include a tub at least partially defining a treating chamber with an access opening. A sump is fluidly coupled to the tub. A liquid recirculation circuit fluidly couples the sump to the treating chamber. The liquid recirculation circuit includes a sprayer having an elongated body defining a longitudinal body axis, with an internal fluid passage and a set of spray openings extending through the body to the internal fluid passage. A deflecting assembly has a carrier and a plurality of deflectors coupled to the carrier, with at least some of the deflectors associated with a corresponding spray opening in the set of spray openings.

20 Claims, 8 Drawing Sheets

(56) References Cited

U.S. PATENT DOCUMENTS

| | | | | |
|---|---|---|---|---|
| 2014/0150831 | A1* | 6/2014 | Forst | A47L 15/4282 134/172 |
| 2017/0273535 | A1 | 9/2017 | Roderick et al. | |
| 2019/0099054 | A1 | 4/2019 | Digman et al. | |
| 2019/0282059 | A1 | 9/2019 | Curtis et al. | |

FOREIGN PATENT DOCUMENTS

| | | | |
|---|---|---|---|
| EP | 2454983 | B1 | 8/2013 |
| WO | 2017211393 | A1 | 12/2017 |

OTHER PUBLICATIONS

European Patent Office, Extended European Search Report corresponding to Application No. 20211726.3 dated Feb. 24, 2021, 3 pgs, Munich, Germany.

* cited by examiner

DISHWASHER WITH A SPRAYER

BACKGROUND

Contemporary automatic dish treating appliances for use in a typical household include a tub that can have an open front and at least partially defines a treating chamber into which dishes can be placed to undergo a treating operation, such as washing. At least one rack for supporting soiled dishes can be provided within the tub. A silverware or utensil basket for holding utensils, silverware, cutlery, and the like, may also be provided and is generally removably mounted to the door or within the dish rack.

A spraying system with multiple sprayers can be provided for recirculating liquid throughout the tub to remove soils from the dishes. The spraying system can include various sprayers, including one or more rotatable sprayers. Various sprayers of the spraying system can be configured to spray toward the racks or baskets or the silverware or utensil basket. One specific type of sprayer that can be included within the spraying system is a sprayer having an elongated body, such as a spray tube or a spray arm, which can be rotatable or not rotatable, and having a plurality of spray openings or nozzles.

BRIEF DESCRIPTION

An aspect of the present disclosure relates to a dish treating appliance for treating dishes according to an automatic cycle of operation, the dish treating appliance comprising a tub at least partially defining a treating chamber with an access opening, a sump fluidly coupled to the tub, and a liquid recirculation circuit fluidly coupling the sump to the treating chamber and including a sprayer having an elongated body defining a longitudinal body axis, with an internal fluid passage and a set of spray openings extending through the body to the internal fluid passage, and a deflecting assembly having a carrier statically fixed relative to the sprayer and a plurality of deflectors coupled to the carrier, with at least some of the deflectors associated with a corresponding spray opening in the set of spray openings, wherein at least a portion of the sprayer is made of a material having a first rate of thermal expansion and at least a portion of the deflecting assembly is made of a second material having a second rate of thermal expansion, different from the first rate of thermal expansion, whereby a change in temperature of the liquid passing through the internal fluid passage results in differential thermal expansion of the portions of the sprayer and the deflecting assembly to effect relative movement between the deflectors and the corresponding spray openings.

Another aspect of the present disclosure relates to a dish treating appliance for treating dishes according to an automatic cycle of operation, the dish treating appliance comprising a tub at least partially defining a treating chamber with an access opening, a sump fluidly coupled to the tub, and a liquid recirculation circuit fluidly coupling the sump to the treating chamber and including a sprayer having an elongated body defining a longitudinal body axis, with an internal fluid passage and a set of spray openings extending through the body to the internal fluid passage, and a deflecting assembly having a carrier statically fixed relative to the sprayer and a plurality of deflectors coupled to the carrier, with at least some of the deflectors associated with a corresponding spray opening in the set of spray openings, wherein at least a portion of the sprayer or at least a portion of the deflecting assembly is made of a material having a rate of thermal expansion, whereby a change in temperature of the liquid passing through the internal fluid passage results in thermal expansion of the at least a portion of the sprayer or of the at least a portion of the deflecting assembly to effect relative movement between the deflectors and the corresponding spray openings.

DETAILED DESCRIPTION

Figure 1:
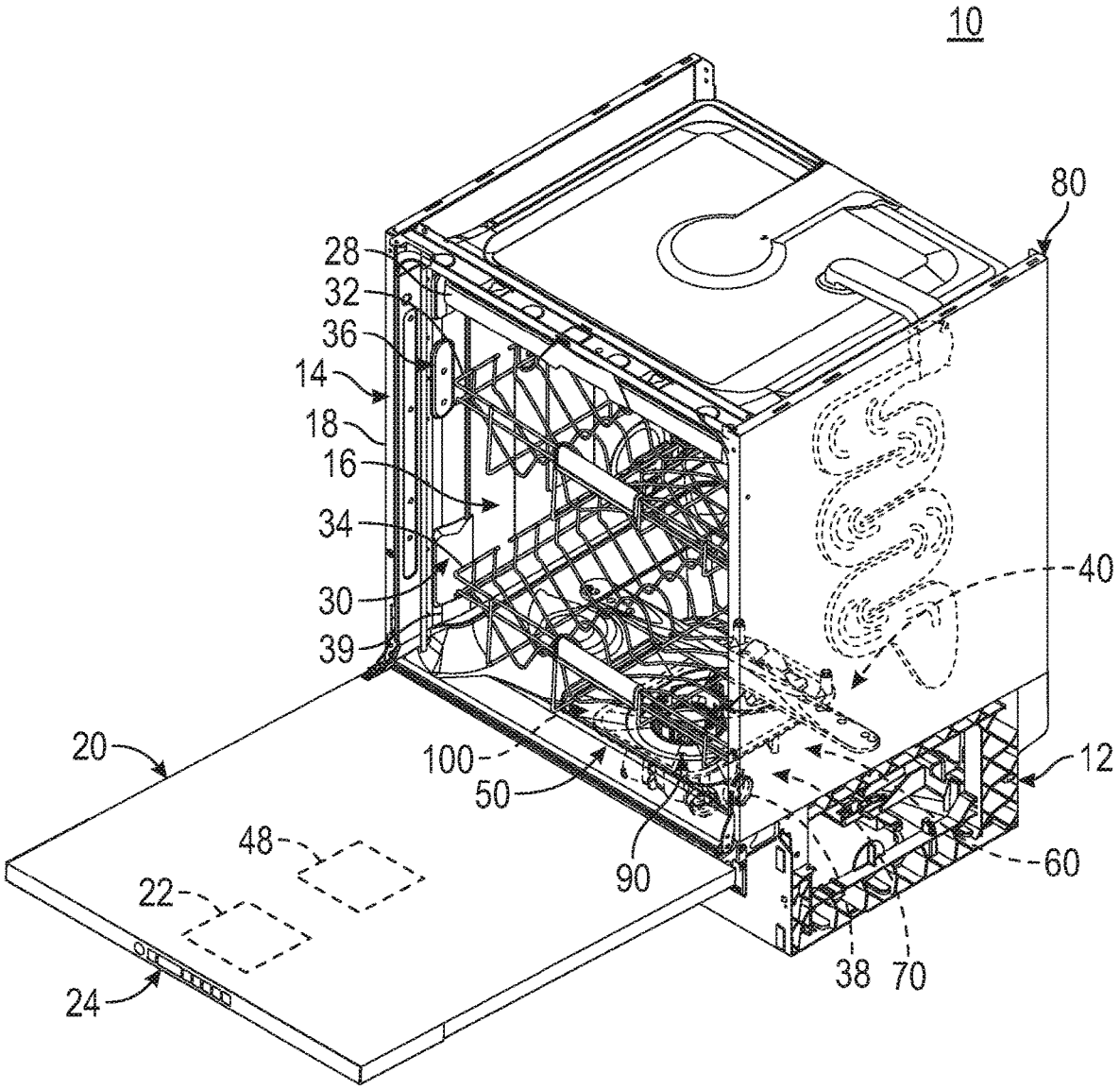
FIG. 1 is a right-side perspective view of an automatic dishwasher having multiple systems for implementing an automatic cycle of operation.

FIG. 1 illustrates an automatic dish treating appliance, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher implementation, which is designed for mounting under a countertop. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an access opening, illustrated herein as an open face 18, for receiving the dishes. A closure in the form of a door assembly 20 can be hingedly or pivotally mounted to the base 12 for movement relative to the tub 14 between opened and closed positions to selectively open and close the open face 18 of the tub 14. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, drying system 80, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
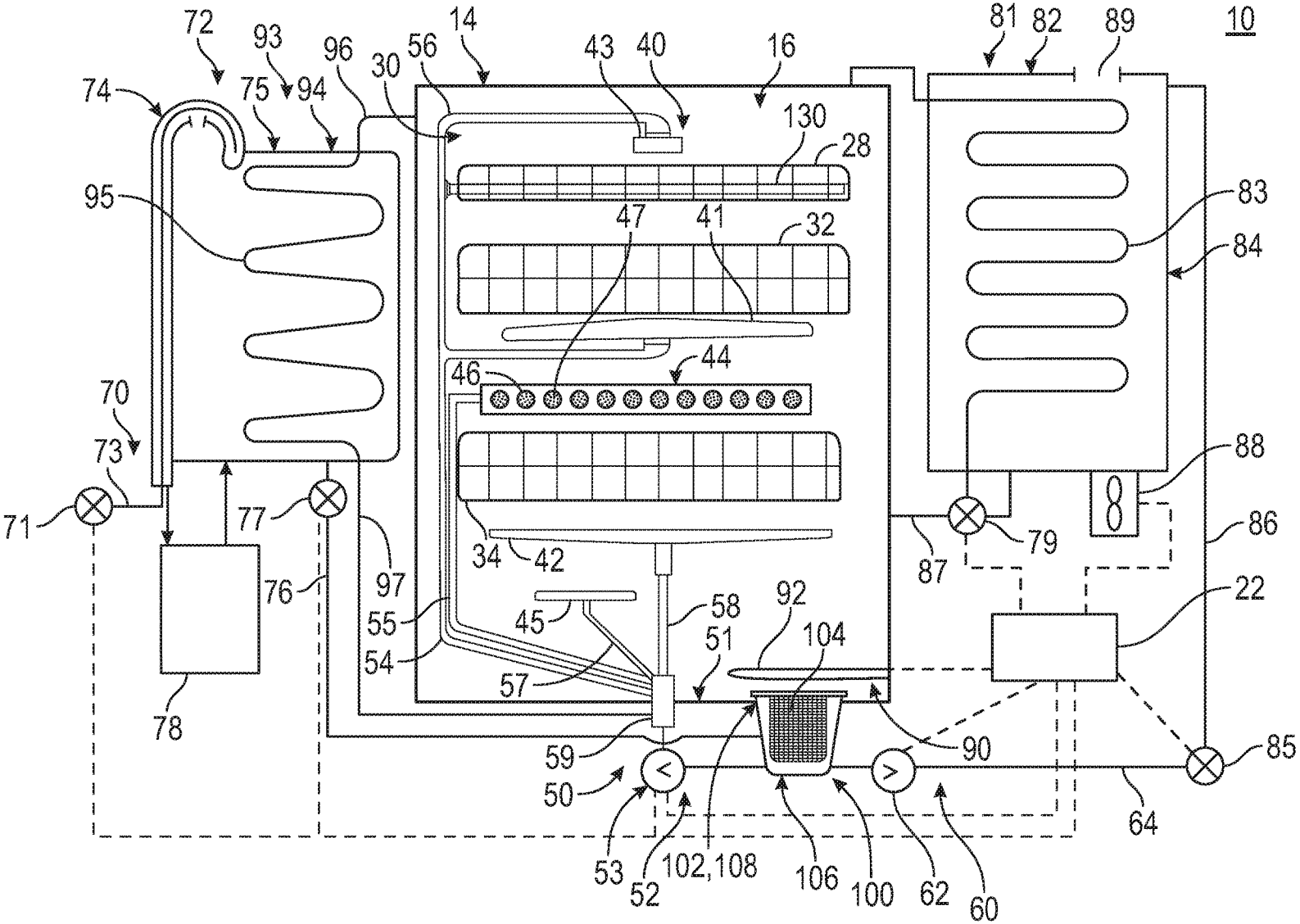
FIG. 2 is a schematic view of the dishwasher of FIG. 1 and illustrating at least some of the plumbing and electrical connections between at least some of systems, including at least one sprayer.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system 80 as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
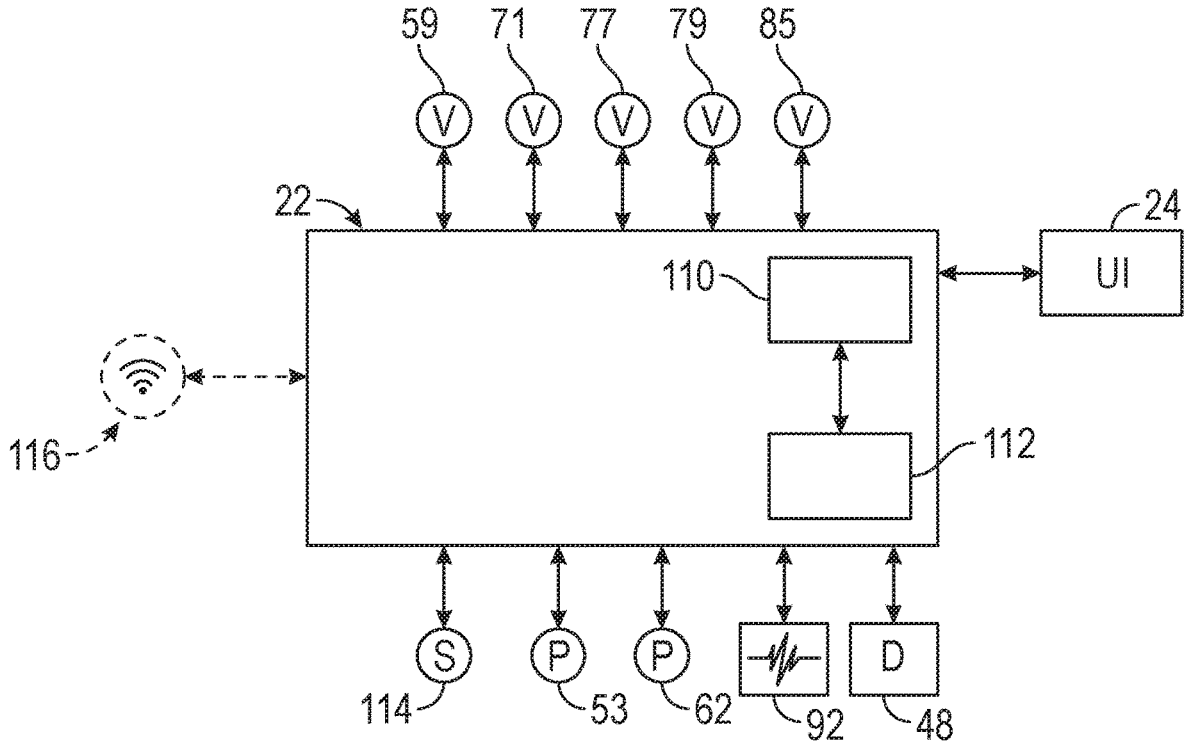
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, and the dispenser assembly 48 for selectively dispensing treating chemistry to the treating chamber 16. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
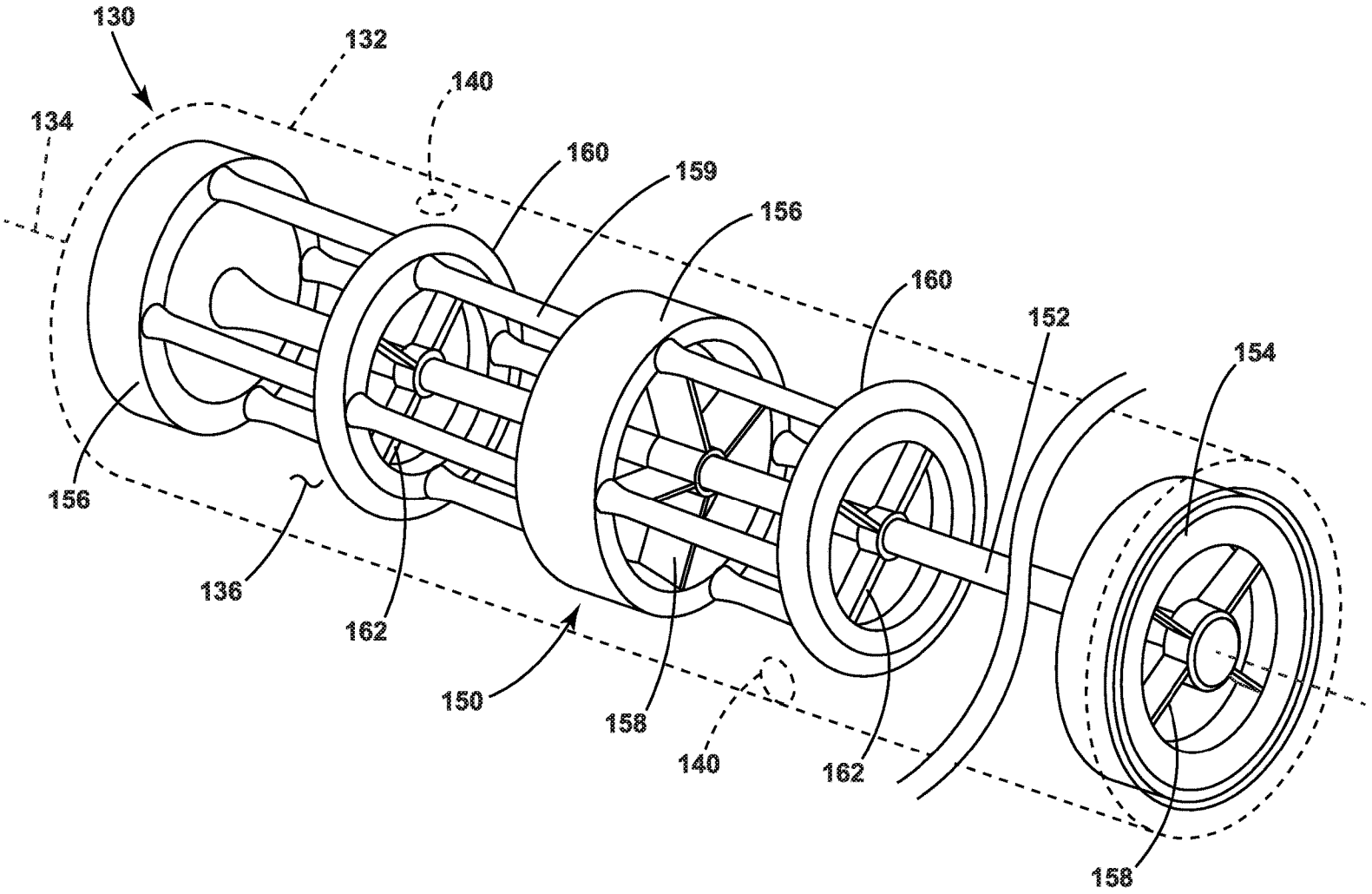
FIG. 4 is a perspective view of a deflecting assembly for use with the sprayer of FIG. 2.

FIG. 4 illustrates a perspective view of the sprayer 130 comprising a deflecting assembly 150. The sprayer 130 has an elongated body 132, shown in dashed lines for a better view of the interior, that defines a longitudinal body axis 134. In one example, the elongated body 132 is provided as a tube that is circular in cross section. The sprayer 130 can be fixed or can be rotatable about a rotation axis defined by the longitudinal body axis 134. The sprayer 130 includes and at least partially defines an internal fluid passage 136 to which liquid is supplied by the recirculation system 50 to be sprayed into the treating chamber 16. The sprayer 130 further comprises a set of spray openings 140 that extend through the body 132 to fluidly couple the internal fluid passage 136 with the treating chamber 16. As used herein, the term a set includes any suitable number of spray openings 140, including only a single spray opening 140. The body 132 can be made of a first material that has a first rate of thermal expansion. In one example, the body 132 can be made of a plastic material.

The deflecting assembly 150 is provided within the sprayer 130 and received within the internal fluid passage 136. The deflecting assembly 150 comprises a carrier, illustrated herein as a shaft 152, that can extend along at least a portion of the length of the sprayer 130. In one example, the shaft 152 extends down the internal fluid passage 136. The shaft 152 is statically fixed relative to the sprayer 130 by an anchor 154. The anchor 154 fixes the deflecting assembly 150 relative to the tub 14 by coupling the deflecting assembly 150 to any suitable fixed element, non-limiting examples of which can include the tub 14, the conduit 54, 56, or to a structure that mounts the sprayer 130, such that the deflecting assembly 150 remains fixed by the anchor 154 whether or not the sprayer 130 rotates. In another example, the anchor 154 can couple the shaft 152 to the sprayer 130 itself, such that the shaft 152 is permitted to rotate with the sprayer 130 but is still statically fixed with respect to lateral movement relative to the sprayer 130.

The deflecting assembly 150 can further comprise at least one support element 156 coupled to and extending radially outwardly from the shaft 152. At least one connecting rib 158 can extend between and couple together the shaft and the at least one support element 156. In one example, the at least one support element 156 can have a ring shape and the connecting rib 158 can be provided as one or more spokes 158 extending from the shaft 152 to the ring-shaped support element 156. The at least one support element 156 can be sized and shaped so as to be complementary to the cross-section of the sprayer 130 such that the at least one support element 156 supports and centers the shaft 152 and the deflecting assembly 150 within and along the length of the sprayer 130. The at least one support element 156 can abut an inner surface of the sprayer 130 or can be provided with a clearance fit relative to an interior of the sprayer 130 to allow a small amount of lateral movement of the deflecting assembly 150 within the sprayer 130. The at least one support element 156 can be provided at any suitable point or points along the length of the shaft 152 to provide the deflecting assembly 150 with sufficient stability within the sprayer 130.

The deflecting assembly 150 further comprises a plurality of deflectors 160 coupled to and extending radially outwardly from the shaft 152. As with the support element 156, at least one connecting rib 162 can extend between and couple the shaft 152 with the deflector 160. In one example, the deflectors 160 have a ring shape and the connecting rib 162 can be provided as one or more spokes 162 extending from the shaft 152 to the ring-shaped deflectors 160. The deflectors 160 can be sized and shaped so as to be complementary to the cross-section of the sprayer 130 such that the deflectors 160 are readily received within the body 132. The deflectors 160 can abut the inner surface of the body 132 or can have a clearance fit relative to the interior of the body 132 such that there is a gap between the deflectors 160 and the body 132. In one example, the deflectors 160 can have a diameter that is slightly smaller than the diameter of the at least one support element 156.

The deflectors 160 can be positioned along the shaft 152 such that at least some of the deflectors 160 are adjacent and associated with a corresponding spray opening 140 in the set of spray openings 140. In one example, the number and the spacing of the deflectors 160 along the shaft 152 can be selected such that one deflector 160 is provided adjacent to and to be associated with each one of the spray openings 140. By providing the deflectors 160 with a ring shape that extends along and adjacent to the entire inner circumference of the body 132, the deflectors 160 can remain adjacent to and associated with the corresponding spray openings 140 regardless of whether or not the sprayer 130 rotates and where the spray openings 140 may be along a path of rotation.

In one example, the shaft 152 can extend between and be coupled to the anchor 154 at a first end of the shaft 152 and the end support element 156 at the opposite end of the shaft 152. The shaft 152 can be fixedly coupled to both the anchor and the end support element 156 by, for example, an interference fit, a molded connection, or a threaded connection. The plurality of deflectors 160 are provided along the shaft 152 between the anchor 154 and the end support element 156. Optionally, at least one additional support element 156 is provided along the shaft 152 between the anchor 154 and the end support element 156. In one example, the deflectors 160 and any additional support elements 156 provided between the anchor 154 and the end support element 156 can be coupled to the shaft 152 by a clearance fit such that the deflectors 160 and the additional support elements 156 are not statically fixed to the shaft 152. Instead, the deflectors 160 and the additional support elements 156 can be statically fixed to at least one of the end support element 156 or the anchor 154 by connectors 159. In this way, the deflectors 160 and the additional support elements 156 are fixed relative to and are carried by at least one end of the shaft 152, but can move along the length of the shaft 152 to the extent permitted by the connectors 159, rather than being individually fixed in position to the shaft 152.

At least a portion of the deflecting assembly 150 can be made of a second material having a second rate of thermal expansion that is different from the first rate of thermal expansion of the material of the body 132. In one example, the portion of the deflecting assembly 150 made of the second material and having the second rate of thermal expansion is the shaft 152. Further, the second rate of thermal expansion can be lower than the first rate of thermal expansion. By way of non-limiting example, the body 132 can be made of a plastic material while at least a portion of the shaft 152 is made of the second material that has a lower rate of thermal expansion than that of the plastic body 132, such as stainless steel or another metal. By further way of non-limiting example, even when the at least a portion of the shaft 152 is made of a metal material, the deflectors 160 can be made from a material that is not the second material, non-limiting examples of which include the same material as the first material of the body 132, or a different material than the first material but still having a similar rate of thermal expansion as the first material.

While the sprayer 130 has been illustrated herein as an elongated tube having a circular cross-section, and the deflecting assembly 150 having a substantially similar shape so as to be received within the elongated tube sprayer 130, it will be understood that the deflecting assembly 150 is not limited to use with the sprayer 130 in the form of a tube, but rather could be used with any suitable sprayer having an elongated body 132 of any suitable shape, such as the lower spray arm 42 or the upper spray arm 41. In the case that the deflecting assembly 150 were provided with a sprayer such as the lower or upper spray arms 42, 41 having an elongated but not tubular shape, the deflecting assembly 150 can have a suitable shape and profile so as to fit within the spray arm 41, 42. Further, in such a case, the spray arm 41, 42 can be rotatable about a rotation axis that is perpendicular or orthogonal to the longitudinal body axis 134 defined by the spray arm 41, 42.

Figure 5:
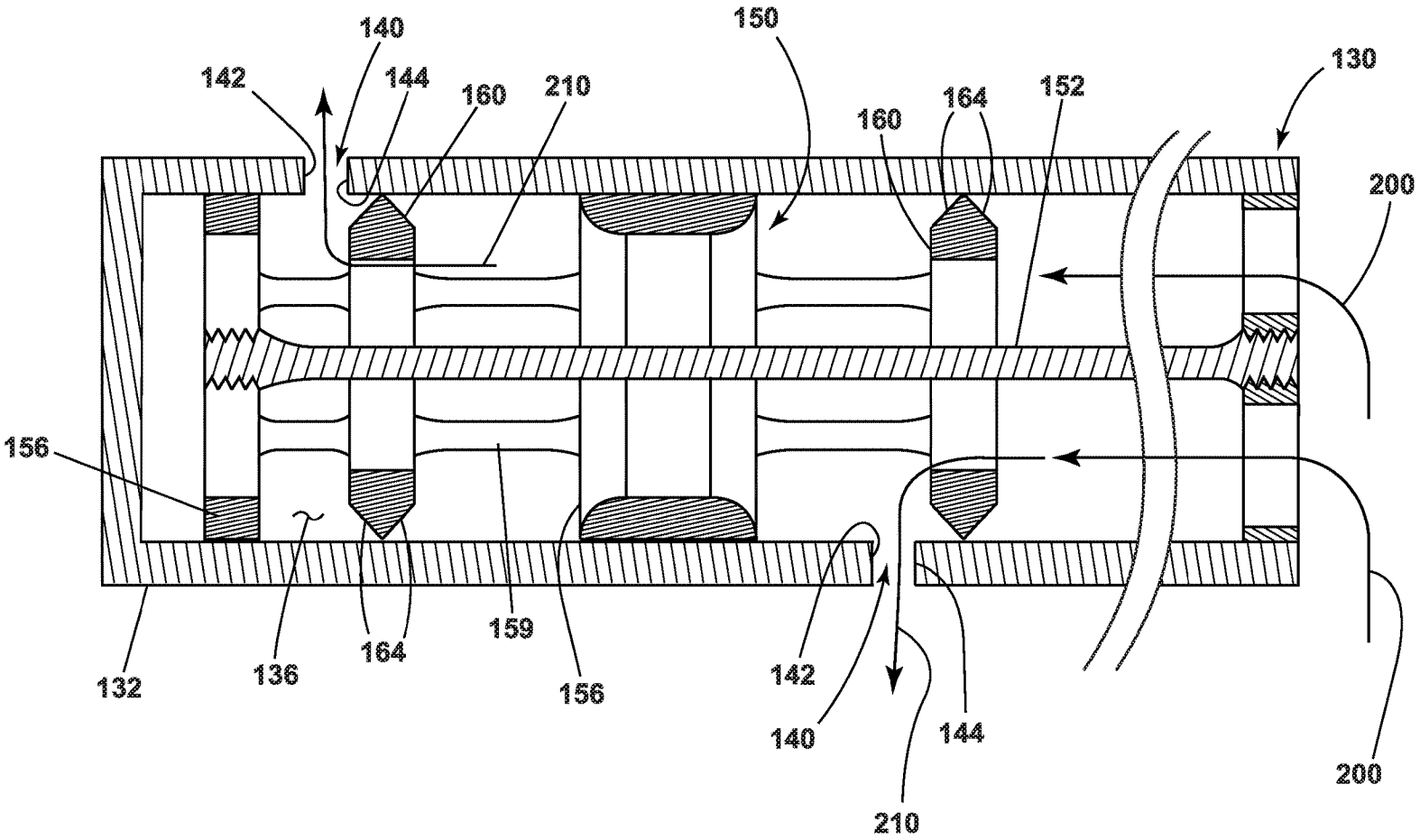
FIG. 5 is a cross-sectional view of the sprayer and the deflecting assembly of FIG. 4.

Referring now to FIG. 5, the positioning of the deflectors 160 adjacent the associated spray openings 140 is illustrated in cross section. Each deflector 160 can be positioned such that the spacing between each deflector 160 and the associated spray opening 140 is the same. Each spray opening 140 has a first, or downstream, end 142, relative to a flow direction of liquid supplied to the sprayer 130, and a second, or upstream, end 144 that is opposite the first end 142. Each deflector 160 defines at least one deflecting surface 164 that is provided at a periphery of the deflector 160 and at the portion of the deflector 160 that is nearest to the spray opening 140.

The at least one deflecting surface 164 can be angled relative to the longitudinal body axis 134 and to the body 132 such that the at least one deflecting surface 164 forms an acute angle with the body 132. By way of non-limiting example, the angle formed between the at least one deflecting surface 164 and the body 132 can be between 0° and 90°, further between 30° and 60°, further between 40° and 50°, further 45°. In one example, and as illustrated herein, the at least one deflecting surface 164 comprises a pair of opposing deflecting surfaces 164. However, it will be understood that the shape and arrangement of the deflector 160 and the at least one deflecting surface 164, as well as the diameter of the deflector 160 and the spacing of the deflector 160 and the at least one deflecting surface 164 relative to the body 132, can have any suitable variety of dimensions, shapes, and angles to produce a desired effective outlet shape of the spray openings 140 and a desired deflection of liquid flow without disrupting the liquid flow to the point that liquid flow through the spray opening 140 is blocked entirely.

When the deflectors 160 and the support elements 156 are cylindrical or ring-shaped as illustrated, such that they are provided about the shaft 152 like wheels with spokes provided about an axle, liquid that is supplied to the internal fluid passage 136 along a flow path 200 is permitted to flow along the length of the internal fluid passage 136 and is not blocked by the deflecting assembly 150. When the liquid flowing along the internal fluid passage 136 reaches one of the spray openings 140, the liquid can flow, such as by being sprayed under pressure, outwardly from the internal fluid passage 136 through the spray opening 140 and to the treating chamber 16 along a spray path 210.

Figure 6:
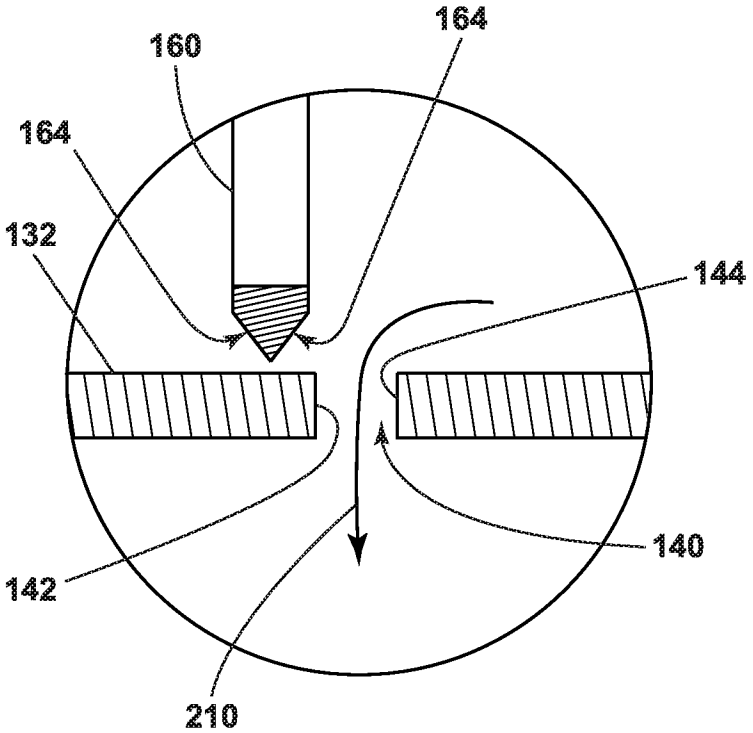
FIG. 6 is an enlarged cross-sectional view of the sprayer and the deflecting assembly of FIG. 5 in a first position relative to one another.

In FIG. 6, the deflector 160 and the spray opening 140 are shown in a first position relative to one another. In the first position, the deflector 160 is adjacent the spray opening 140, and specifically adjacent the first, downstream end 142 of the spray opening 140, but does not extend beyond the first, downstream end 142 to overlie the spray opening 140. In the first position, the spray path 210 is unaffected by the deflector 160 and liquid follows the spray path 210 substantially straight through the spray opening 140.

Figure 7:
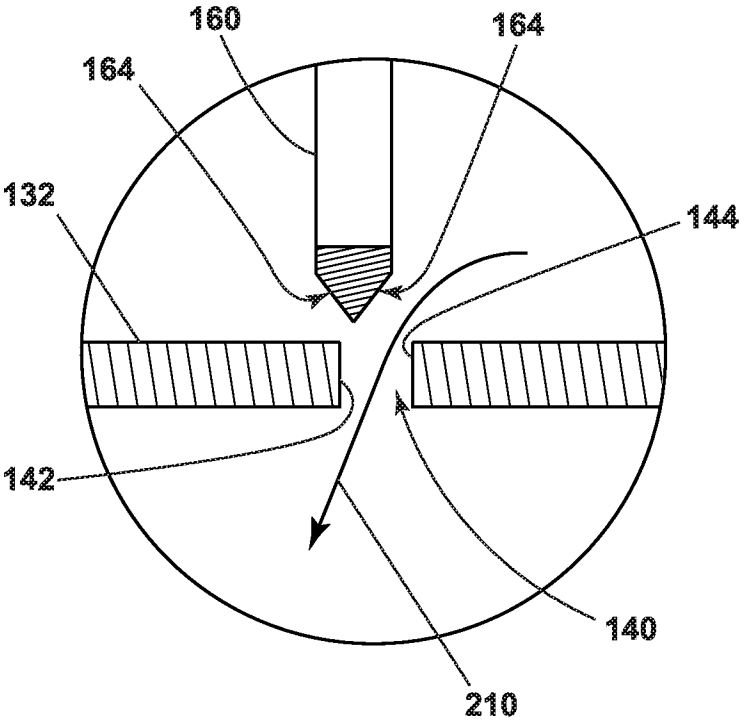
FIG. 7 is an enlarged cross-sectional view of the sprayer and the deflecting assembly of FIG. 5 in a second position relative to one another.

In FIG. 7, the deflector 160 and the spray opening 140 are shown in a second position relative to one another. In the second position, the deflector 160 and the spray opening 140 are moved relative to one another as compared to the first position, such that the deflector 160 is positioned beyond the first, downstream end 142 and at least partially overlying the spray opening 140. In the second position, liquid flowing within the internal fluid passage 136 confronts a first one of the pair of deflecting surfaces 164 before following the spray path 210 through the spray opening 140. In this way, the liquid passes between the first deflecting surface 164 and the second, upstream end 144 prior to flowing through the spray opening 140, causing the spray path 210 to be deflected relative to the spray path 210 of the first position.

Figure 8:
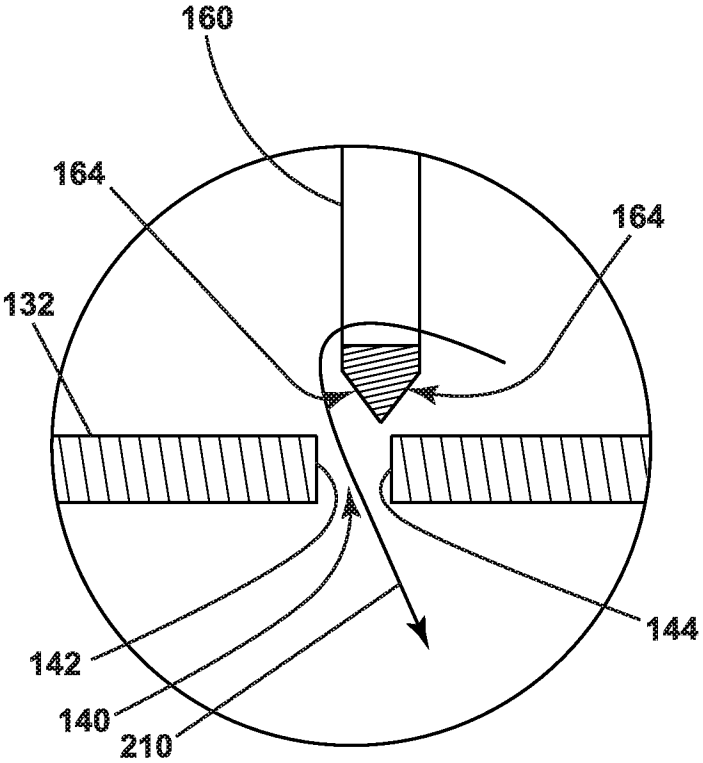
FIG. 8 is an enlarged cross-sectional view of the sprayer and the deflecting assembly of FIG. 5 in a third position relative to one another.

In FIG. 8, the deflector 160 and the spray opening 140 are shown in a third position relative to one another. In the third position, the deflector 160 and the spray opening 140 are moved relative to one another as compared to the first and second positions, such that the deflector 160 is positioned entirely past the first, downstream end 142, still at least partially overlying the spray opening 140, and at least partially overlying the second, upstream end 144. In the third position, liquid flowing within the internal fluid passage 136 is prevented from reaching the spray opening 140 without flowing beyond the deflector 160. Instead, the liquid flows beyond and through the deflector 160 before following the spray path 210 through the spray opening 140. In this way, the liquid confronts and flows along a second one of the pair of deflecting surfaces 164 and passes between the second deflecting surface 164 and the first, downstream end 142 prior to flowing through the spray opening 140, causing the spray path 210 to be deflected relative to the spray path 210 of both the first position and the second position. In one example, the spray path 210 associated with the third position deflects the liquid in a direction opposite than the spray path 210 of the second position, relative to spray path 210 of the first position.

Figure 9:
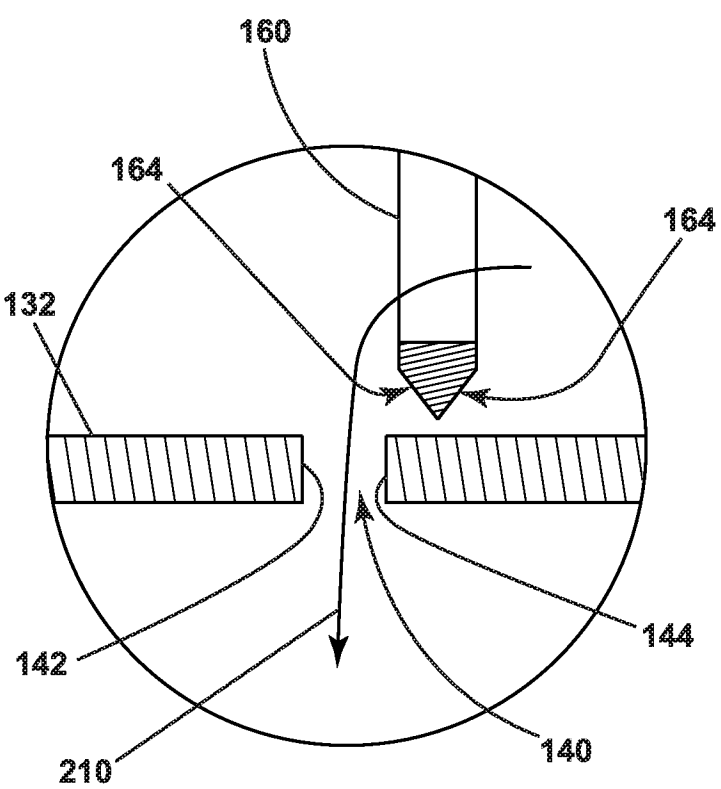
FIG. 9 is an enlarged cross-sectional view of the sprayer and the deflecting assembly of FIG. 5 in a fourth position relative to one another.

In FIG. 9, the deflector 160 and the spray opening 140 are shown in a fourth position relative to one another. In the fourth position, the deflector 160 and the spray opening 140 are moved relative to one another as compared to the first, second, and third positions, such that the deflector 160 is positioned entirely past the second, upstream end 144 and no longer overlies the spray opening 140. In the fourth position, like the third position, liquid flowing within the internal fluid passage 136 is prevented from reaching the spray opening 140 without flowing beyond the deflector 160. Instead, the liquid flows beyond and through the deflector 160 before following the spray path 210 through the spray opening 140. Because the deflector 160 does not overlie the spray opening 140, as in the first position, the spray path 210 is substantially unaffected by the deflector 160 such that liquid follows the spray path 210 substantially straight through the spray opening 140. In one example, the spray path 210 associated with the fourth position can be the same as the spray path 210 associated with the first position.

Figure 10:
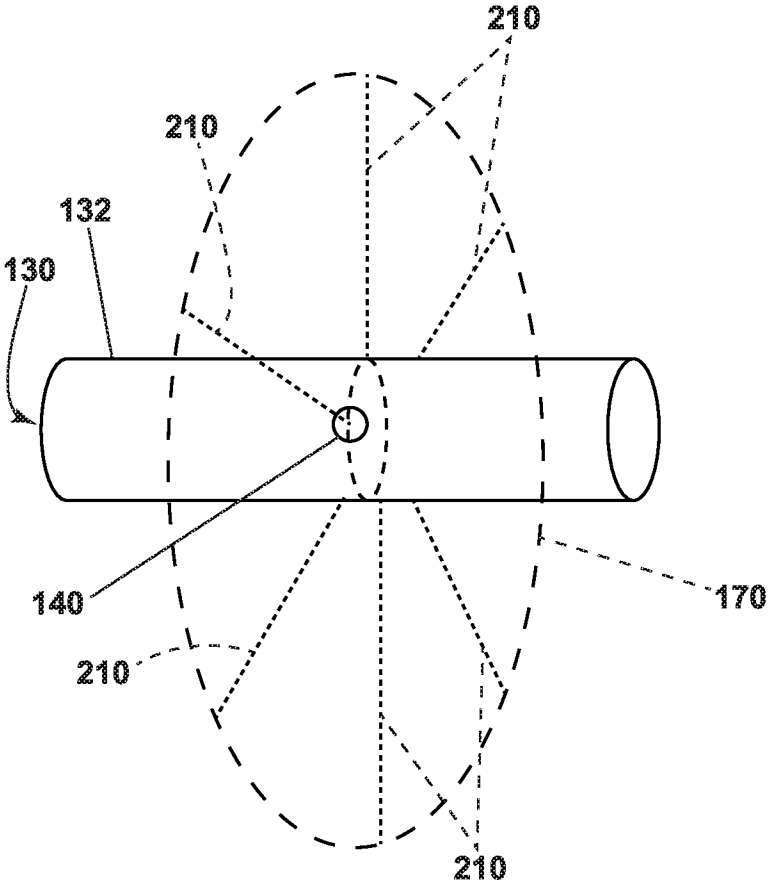
FIG. 10 is a schematic illustration of an example of a spray pattern of the sprayer of FIG. 4.

Referring now to FIG. 10, in the case that the sprayer 130 is provided as a rotatable sprayer 130, the rotation of the body 132 allows for liquid to be sprayed along the spray path 210 from one single spray opening 140 and to provide liquid spray in a spray pattern 170 that extends 360° about the body 132 as the body 132 completes a rotation about the longitudinal body axis 134. However, while the liquid spray is provided about the spray pattern 170 to cover the 360° around the sprayer 130, the spray pattern 170 that is reached by the liquid following the spray path 210 without interaction with the deflecting assembly 150, such as when the deflector 160 and the spray opening 140 are in the first position, is limited to a single plane along the length of the sprayer 130. Thus, portions of the racks 28, 32, 34, or dishes placed thereon, that are not directly aligned with the spray path 210 exiting straight through the spray opening 140 may not be cleaned as well during the cycle of operation.

Figure 11:
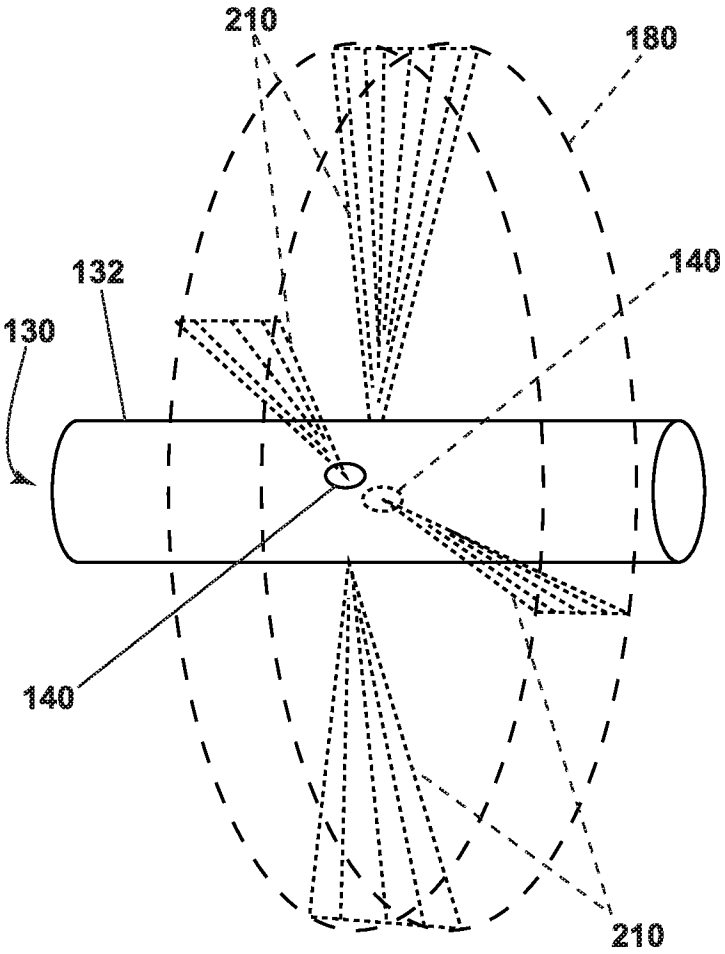
FIG. 11 is a schematic illustration of another example of a spray pattern of the sprayer and the deflecting assembly of FIG. 4.

Referring now to FIG. 11, when the sprayer 130 is rotatable about the longitudinal body axis 134 and when the deflecting assembly 150 moves from the first position to the fourth position relative to the spray opening 140, not only is liquid spray provided from the one single spray opening 140 to cover the 360° around the sprayer 130, the liquid is additionally provided in a spray pattern 180 in multiple planes along the length of the sprayer 130. The deflection of the spray path 210 by the deflecting assembly 150 generates the spray pattern 180 that provides the liquid spray along a greater portion of the length of the sprayer 130 than the spray pattern 170. Thus, portions of the racks 28, 32, 34, or dishes placed thereon, that are not directly aligned with the spray path 210 exiting straight through the spray opening 140 can be reached by the spray pattern 180 that were not reached by the spray pattern 170.

Turning now to the operation of the sprayer 130 and the deflecting assembly 150, during the cycle of operation of the dishwasher 10, liquid can be supplied to the sprayer 130 to pass through the internal fluid passage 136 and exit the sprayer 130 through the spray openings 140. The liquid that is supplied to the sprayer 130 can be heated liquid. In one example, the temperature of the liquid that is supplied to the sprayer 130 can increase during the cycle of operation. By way of non-limiting example, liquid that is initially supplied to the sprayer 130 can have a temperature of 85° F., and the temperature of the liquid can further increase from 85° F. to 140° F. throughout the cycle of operation. As the temperature of the liquid passing through the internal fluid passage 136 increases during the cycle of operation, at least a portion of the sprayer 130 or at least a portion of the deflecting assembly 150 undergoes thermal expansion. As at least one of the at least a portion of the sprayer 130 or the at least a portion of the deflecting assembly 150 thermally expands, relative movement between the deflectors 160 and the corresponding spray openings 140 is effected such that the deflectors 160 and the corresponding spray openings 140 are moved relative to one another from the first position, which can correspond to the relative positioning of the deflectors 160 and the spray openings 140 when the liquid passing through the internal fluid passage 136 is at room temperature, to the fourth position, which can correspond to the relative positioning of the deflectors 160 and the spray openings 140 when the liquid passing through the internal fluid passage 136 is at the highest temperature of the cycle of operation, such as during the final rinse phase, which can be a temperature of 140° F.

As described herein, the body 132 can be made of the first material having the first rate of thermal expansion while at least a portion of the deflecting assembly 150 is made of the second material having the second, lower rate of thermal expansion. By way of non-limiting example, when the body 132 is made of a plastic material and the shaft 152 is made of metal, the increase in temperature of the liquid passing through the internal fluid passage 136 during the cycle of operation causes differential thermal expansion of the portions of the sprayer 130 and the deflecting assembly 150, ensuring that the sprayer 130 and the deflecting assembly 150 do not thermally expand at the same rate and in the same direction, resulting in relative movement between the deflectors 160 and the corresponding spray openings 140 from the first position to the fourth position.

Further, because the deflecting assembly 150 can be anchored by at least the anchor 154, and optionally also by the end supporting element 156, the attachment points of the deflectors 160 to the shaft 152 can be selected such that the direction of thermal expansion of the deflecting assembly 150 can be controlled. In one example, the at least a portion of the sprayer 130 and the at least a portion of the deflecting assembly 150 can thermally expand in opposite directions. In one example, the thermal expansion of the at least a portion of the sprayer 130 and the at least a portion of the deflecting assembly 150 during the cycle of operation can result in a net relative movement between the deflectors 160 and the spray openings 140 of 3-4 millimeters.

Regardless of whether only one of the sprayer 130 or the deflecting assembly 150 thermally expands or whether both the sprayer 130 and the deflecting assembly 150 thermally expand at different rates, relative movement between the deflectors 160 and the spray openings 140 occurs. As the deflectors 160 and the spray openings 140 move from the first position to the fourth position, the angle of the spray path 210 is altered as the effective outlet shape of the corresponding spray openings 140 is altered by the movement and positioning of the deflectors 160. The materials of the sprayer 130 and the deflecting assembly 150, or at least the first material and the second material, can be selected such that the differential thermal expansion between the materials, and specifically as the temperature of the liquid passing through the internal fluid passage 136 increases from 85° F. to 140° F., is sufficient to move the deflectors 160 and the corresponding spray openings 140 relative to one another between the first position, wherein the deflectors 160 are positioned at the first, downstream end 142 of the corresponding spray openings 140, and the second position, wherein the deflectors 160 have traveled past the width of the spray openings 140 and are positioned at the second, upstream end 144 of the corresponding spray openings 140.

In the same way, the size, and specifically the diameter or width, of the spray openings 140, as well as the width of the deflectors 160, can be selected specifically so that the relative movement of the deflectors 160 and the corresponding spray openings 140 relative to one another, and taking into account the rates of thermal expansion of the first and second materials, is sufficient to move the deflectors 160 from the first, downstream end 142, past the width of the spray openings 140, and to the second, upstream end 144 of the corresponding spray openings 140.

Like the size of the spray openings 140, the width of the deflectors 160, and the rates of thermal expansion of the first and second materials can be parameters that are selectable to produce a desired range or extent of relative movement between the deflectors 160 and the corresponding spray openings 140, the temperature of the liquid supplied to the internal fluid passage 136 can also be a selectable parameter for producing a desired relative movement or a desired position of the deflectors 160 and the corresponding spray openings 140. Hot or cold water can be selectively supplied to the internal fluid passage 136 in order to actively adjust the position of the deflectors 160 relative to the corresponding spray openings 140 such that controlling the temperature of the liquid supplied to the internal fluid passage 136 in turn controls the position of the deflectors 160 relative to the corresponding spray openings 140, and thus also controls the trajectory of the spray path 210.

It will be understood that any suitable temperature, range of temperatures, or pattern of temperature changes for the liquid supplied to the internal fluid passage 136 can be used to produce the desired relative movement between the deflectors 160 and the corresponding spray openings 140. By way of non-limiting example, rather than having the temperature of the supplied liquid only increase from 85° F. to 140° F. during the cycle of operation, liquid could be initially supplied to the internal fluid passage 136 at a cold water temperature, prior to the heating of the liquid, in order to place the deflectors 160 at an initial or a starting position, or the increase of the temperature from 85° F. to 140° F. can be interrupted by at least one dwell at a lower temperature, either by natural cooling of the liquid or by active supply of cold water, or by supplying liquid at a cold water temperature after the heating of the liquid from 85° F. to 140° F. has been completed, such as by natural cooling of the liquid, by supplement with cold water, or by supplying an entirely new charge of cold water.

The aspects described herein provide a deflecting assembly for improving cleaning performance of sprayers within a dishwasher by altering the trajectory of liquid being sprayed from spray openings along a spray path throughout the course of a cycle of operation. In this manner, improved coverage of the spray from the sprayer is realized as compared to a sprayer that does not include the deflecting assembly, which results in improved cleaning performance. When the deflecting assembly is not included, placement of a dish even only 2-3° off from alignment with the spray opening can negatively affect cleaning performance. Further, the deflecting assembly described herein realizes this improved spray coverage from each sprayer, and even from each spray opening on the sprayer, without requiring a mechanically or electrically actuated deflector. Instead, the deflecting assembly functions based on the temperature increase of water throughout the cycle of operation that occurs within the dishwasher, avoiding the potential increased costs and increased manufacturing and assembly effort that may be required with a mechanically or electrically actuated deflector.

It will also be understood that various changes and/or modifications can be made without departing from the spirit of the present disclosure. By way of non-limiting example, although the present disclosure is described for use with a dishwasher having a door assembly pivotable about a horizontal axis, it will be recognized that the door assembly can be employed with various constructions, including door assemblies pivotable about a vertical axis and/or door assemblies for drawer-style dishwashers.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish treating appliance for treating dishes according to an automatic cycle of operation, the dish treating appliance comprising:

a tub at least partially defining a treating chamber with an access opening;

a sump fluidly coupled to the tub; and a liquid recirculation circuit fluidly coupling the sump to the treating chamber and including:

a sprayer having an elongated body defining a longitudinal body axis, with an internal fluid passage and a set of spray openings extending through the body to the internal fluid passage; and a deflecting assembly positioned within the sprayer body and having a shaft statically fixed relative to the sprayer body and a plurality of ring shaped deflectors coupled to the shaft with at least some of the plurality of ring shaped deflectors associated with a corresponding spray opening in the set of spray openings in the elongated body, the plurality of ring shaped deflectors configured to deflect liquid through the set of spray openings;

wherein at least a portion of the elongated body of the sprayer comprises a first material having a first rate of thermal expansion and at least a portion of the shaft comprises a second material having a second rate of thermal expansion, different from the first rate of thermal expansion, whereby a change in temperature of the liquid passing through the internal fluid passage results in differential thermal expansion of the shaft and the elongated body such that the shaft moves the plurality of ring shaped deflectors along the longitudinal axis and relative to the corresponding spray openings in the elongated body.

2. The dish treating appliance of claim 1 wherein the deflecting assembly is provided within the internal fluid passage.

3. The dish treating appliance of claim 1 wherein the elongated body and the shaft thermally expand in opposite directions.

4. The dish treating appliance of claim 1 wherein the second rate of thermal expansion is lower than the first rate of thermal expansion.

5. The dish treating appliance of claim 1 wherein the relative movement between the plurality of ring shaped deflectors and the corresponding spray openings alters a trajectory of liquid being sprayed from the spray openings.

6. The dish treating appliance of claim 1 wherein the differential thermal expansion is sufficient to move the plurality of ring shaped deflectors and the corresponding spray openings relative to one another between a first position wherein the plurality of ring shaped deflectors are positioned at a first end of the corresponding spray openings and a second position wherein the plurality of ring shaped deflectors are positioned at a second end, opposite the first end, of the corresponding spray openings.

7. The dish treating appliance of claim 6 wherein the differential thermal expansion effecting the relative movement of the plurality of ring shaped deflectors and the corresponding spray openings from the first position to the second position occurs as the temperature of the liquid passing through the internal fluid passage increases from 85° F. to 140° F.

8. The dish treating appliance of claim 1 wherein the sprayer is rotatable about the longitudinal body axis or about an axis perpendicular to the longitudinal body axis.

9. The dish treating appliance of claim 1 wherein the shaft extends a length of the internal fluid passage.

10. The dish treating appliance of claim 9 wherein a portion of the shaft is anchored to the sprayer.

11. The dish treating appliance of claim 9 wherein the plurality of ring shaped deflectors extend radially from the shaft.

12. The dish treating appliance of claim 1 wherein the sprayer is fixed in the dish treating appliance.

13. The dish treating appliance of claim 12 further comprising at least one support element coupled to and extending radially outwardly from the shaft.

14. The dish treating appliance of claim 13 wherein the at least one support element is complementary in shape to the sprayer body.

15. The dish treating appliance of claim 14 wherein the at least one support element centers the shaft relative to the elongated body.

16. The dish treating appliance of claim 11 further comprising at least one connecting rib extending between the shaft with the deflector.

17. The dish treating appliance of claim 13 wherein the deflecting assembly comprises a first end and a second end spaced from the first end, the first end and the second end comprising support elements with the shaft extending therebetween.

18. The dish treating appliance of claim 17 wherein the plurality of ring shaped deflectors are positioned in between the support elements.

19. The dish treating appliance of claim 18 further comprising a third support element positioned in between the plurality of ring shaped deflectors.

20. The dish treating appliance of claim 19 further comprising a plurality of connectors connecting the support elements to the plurality of ring shaped deflectors.

* * * * *